US005249987A

United States Patent [19]

Kristiansen

[11] Patent Number: 5,249,987

[45] Date of Patent: Oct. 5, 1993

[54] CAP FOR MODULAR JACK

[75] Inventor: Ralph Kristiansen, Roanoke, Va.

[73] Assignee: Virginia Patent Development Corporation, Roanoke, Va.

[21] Appl. No.: 857,601

[22] Filed: Mar. 31, 1992

[51] Int. Cl.[5] ..... H01R 23/02

[52] U.S. Cl. ..... 439/676; 439/686; 439/689

[58] Field of Search ..... 439/851, 842, 676, 695, 439/696, 701, 686, 687, 689, 690, 691, 752

[56] References Cited

U.S. PATENT DOCUMENTS

| | | | |
|---|---|---|---|
| 4,210,376 | 7/1980 | Hughes et al. . | |
| B1 4,210,376 | 3/1984 | Hughes et al. . | |
| 4,457,570 | 7/1984 | Bogese, II . | |
| 4,501,464 | 2/1985 | Bogese, II . | |
| 4,577,921 | 3/1986 | Bogese, II . | |
| 4,593,966 | 6/1986 | Meyer | 439/676 |
| 4,717,217 | 1/1988 | Bogese, II . | |
| 4,732,568 | 3/1988 | Hall | 439/676 |
| 4,767,355 | 8/1988 | Phillipson et al. | 439/676 |

FOREIGN PATENT DOCUMENTS

| | | | |
|---|---|---|---|
| 3963413 | 1/1990 | Fed. Rep. of Germany | 439/676 |

*Primary Examiner*—David L. Pirlot
*Attorney, Agent, or Firm*—Saidman DesignLaw Group

[57] ABSTRACT

A new and improved modular jack which employs a unique jack cap that prevents accidental electrical malfunctions when the conductors of the modular jack are in an overstressed condition. The jack cap also features means for inhibiting high voltage arcing, and for securing the cap to the jack housing even under such extreme conditions.

32 Claims, 8 Drawing Sheets

CAP FOR MODULAR JACK

BACKGROUND OF THE INVENTION

I. Field of the Invention

The present invention relates to telephone-style modular jacks and, more particularly, is directed towards a cap member utilized in combination with such modular jacks.

II. Description of Related Art

Telephone-style modular plugs and jacks are well known. They are widely used as general interconnect devices for a variety of types of electrical equipment. As utilized herein, the terms "modular jack" and "modular plug" connote the miniature, interchangeable, quick-connect-and-disconnect jacks and plugs developed by Western Electric Company and Bell Telephone Laboratories originally for use with telephone equipment. See, for example, U.S. Pat. Nos. 3,699,498; 3,850,497; and 3,860,316.

Several modular jacks have been proposed for directly coupling a modular plug to a printed circuit board. See, for example, U.S. Pat. Nos. 4,210,376; 4,457,570; 4,501,464; 4,577,921; and 4,717,217.

In prior U.S. Pat. No. 4,457,570, assigned to the same assignee as the present application, there is described an improved modular jack whose principal feature is the provision of conductors which enter the plug-receiving cavity of the jack from the rear of the jack, rather than from the front of the jack as with previous designs. This feature results in substantial economies as a result of the reduction in required conductor length, and the like.

An improved version of this modular jack is set forth in copending application Ser. No. 07/827,878, filed Jan. 30, 1992, assigned to the same assignee as the present application, which is specifically incorporated herein by reference. Modular jacks as set forth in the cited copending application are manufactured and sold by Virginia Plastics Company, Inc. of Roanoke, Va., licensee of the present assignee, as, for example, MODCOM-C® Part No. 020.000.229.

The latter modular jack provides many advantages over parts previously available. For one thing, contact failure due to overstress is greatly reduced. The signal transfer surface area between the male and female conductors is optimized. Uniform contact resistance is obtained independently of the depth of insertion of the plug into the jack, and the likelihood of vibration-triggered open circuits is reduced. Finally, assembly and manufacturing are greatly simplified over prior designs. These improvements resulted from modifications to the housing and contact structure that are set forth in full in the referenced copending application, and which will be explained briefly hereinafter.

Despite the great improvement manifested by the MODCOM-C® connectors over the prior art, a few areas remain for further improvement. For example, while the configuration of the housing and conductors greatly minimizes overstressed contacts under normal use, the contacts can nevertheless be overstressed in situations where, for example, someone inserts an improper size of modular plug into the modular jack. Most frequently, the outer contacts of the jack are the ones which are caused to over extend upwardly into an overstressed condition.

Although overstressing the conductors is in and of itself not desirable, since thereafter the conductors may not operate with optimum contact pressure, there is another danger associated with overstressing these contacts. Namely, if stretched too far upwardly out of the housing, the contacts can touch the exposed surface of an adjacent panel or circuit board and produce an undesirable inadvertent electrical or ground connection.

Another situation which can occur in high voltage conditions is arcing across the jack cap and contacts. This is believed to result in part from an air gap that is created adjacent the contacts. It is also possible in such a situation for the jack cap to lift off the housing. It would be highly desirable if some means could be provided for minimizing high voltage arcing, and for keeping the jack cap in place on the housing.

It is towards overcoming the additional deficiencies noted above that the present invention is advanced.

OBJECTS AND SUMMARY OF THE INVENTION

It is therefore a primary object of the present invention to provide a new and improved telephone-style modular jack which effectively prevents the spring contact portions of its conductors from over extending so as to touch adjacent electrical devices.

Another object of the present invention is to provide a new and improved telephonestyle modular jack which effectively insulates the spring contact portions of its conductors from inadvertently shorting to adjacent electrical devices.

A still further object of the present invention is to provide a new and improved modular jack which overcomes the above-noted deficiencies and which can be used in tight enclosures (e.g., a panel opening).

A still further object of the present invention is to provide a new and improved cap for a modular jack which reduces the possibility of high voltage arcing by minimizing the likelihood of creating an air gap around the jack cap.

Another object of the present invention is to provide a modular jack housing and cap structure that reduces the likelihood of the cap inadvertently lifting off of the housing.

The foregoing and other objects are attained in accordance with one aspect of the present invention through the provision of a telephone-type modular jack of the type that connects a telephone-type modular plug with a printed circuit board. The jack comprises a housing having a front portion, a rear portion, an upper outer wall, an opening formed in the front portion of the housing for receiving the telephone-type modular plug having a cord terminated by a plurality of side-by-side, substantially planar contact terminals, the contact terminals including a substantially flat, elongated upper edge surface. The jack further includes a plurality of electrical conductors arranged in a side-by-side, spaced apart fashion in the housing. Each of the conductors includes an end portion extending normally from the rear portion of the housing for insertion through a corresponding hole formed in the printed circuit board. A spring contact portion extends into the opening from the rear portion of the housing towards the front portion of the housing and includes a substantially linear lower portion, and an intermediate portion formed between the end portion and the spring contact portion. The upper edge surface of the contact terminals of the plug engage the linear portion of the spring contact portion of the conductors, causing the spring contact portions to be pivoted upwardly about a fulcrum point upon insertion of the telephone-type modular plug into the opening of the telephone-type modular jack. Finally, in accordance with the present invention, means are preferably provided for limiting the upward movement of the spring contact portions of the conductors.

The means for limiting the upward movement of the spring contact portions of the conductors comprises a separable cap member having a main body portion and bearing means positioned in contact with the intermediate portion of the conductors for defining the fulcrum point for the spring contact portions positioned forwardly of the fulcrum point.

In accordance with other aspects of the present invention, the separable cap member preferably includes cover means extending from the main body portion over the spring contact portions of the conductors for covering same. The separable cap member also preferably includes means for securing it to the housing. The bearing means is generally located on the underside of the cap member, while the cover means extends forwardly from the main body portion. More particularly, the cover means extends integrally from and is flexibly secured to the main body portion of the separable cap member.

The cover means flexes upwardly in response to pressure on its undersurface from the spring contact portions of the conductors. The cover means is preferably substantially rectangular and covers substantially the entire opening above the spring contact portions of the conductors.

In accordance with yet another aspect of the present invention, the means for limiting upward movement of the spring contact portions also preferably includes means for insulating the spring contact portions from touching other electrical devices.

In accordance with yet other aspects of the present invention, the separable cap member more particularly includes a forward edge and lateral edges. The means for securing the cap member to the housing preferably comprises means formed along the lateral edges of the cap member for interfacing with complimentary means formed in the housing of the modular jack. The means formed along the lateral edges of the cap member in one embodiment comprises a stairstep configuration; in another embodiment comprises a wedge-shaped configuration; and in yet a third embodiment comprises a step and reverse-wedge configuration. Such configurations also help prevent high voltage arching in the jack by inhibiting formation of an air gap in the cap.

In accordance with a further aspect of the present invention, there is provided a modular, telephone-type electrical connector comprising a modular jack that is characterized by a housing and a plurality of conductors arranged side-by-side in the housing. Each conductor includes a printed circuit matable portion and a spring contact matable portion for mating with the modular plug. The spring contact portion extends into the housing from the rear to the front, and is adapted to move upwardly in a direction out of the housing upon insertion of a modular plug into the housing. Finally, removable cover means for insulating the spring contact portions of the conductors from touching other components when moving upwardly out of the housing are provided. This removable cover means also inherently includes means for limiting the upward movement of the spring contact portions. The removable cover means preferably comprises a relatively thin, flexible cover portion that overlies the spring contact portions and includes lateral sides for lockably seating the cover portion in the housing.

BRIEF DESCRIPTION OF THE DRAWINGS

The foregoing and other objects, aspects, features and advantages of the present invention will be more fully appreciated as the same becomes better understood from the following detailed description of the present invention when considered in connection with the accompanying drawings, in which.

DETAILED DESCRIPTION OF THE PREFERRED EMBODIMENT

Figure 1:
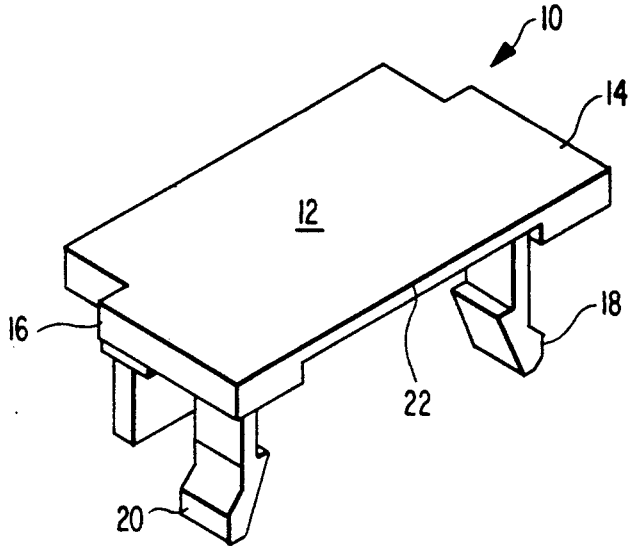
FIG. 1 PRIOR ART
FIG. 1 is a top, perspective view of a prior art cap for a modular jack.
Figure 2:
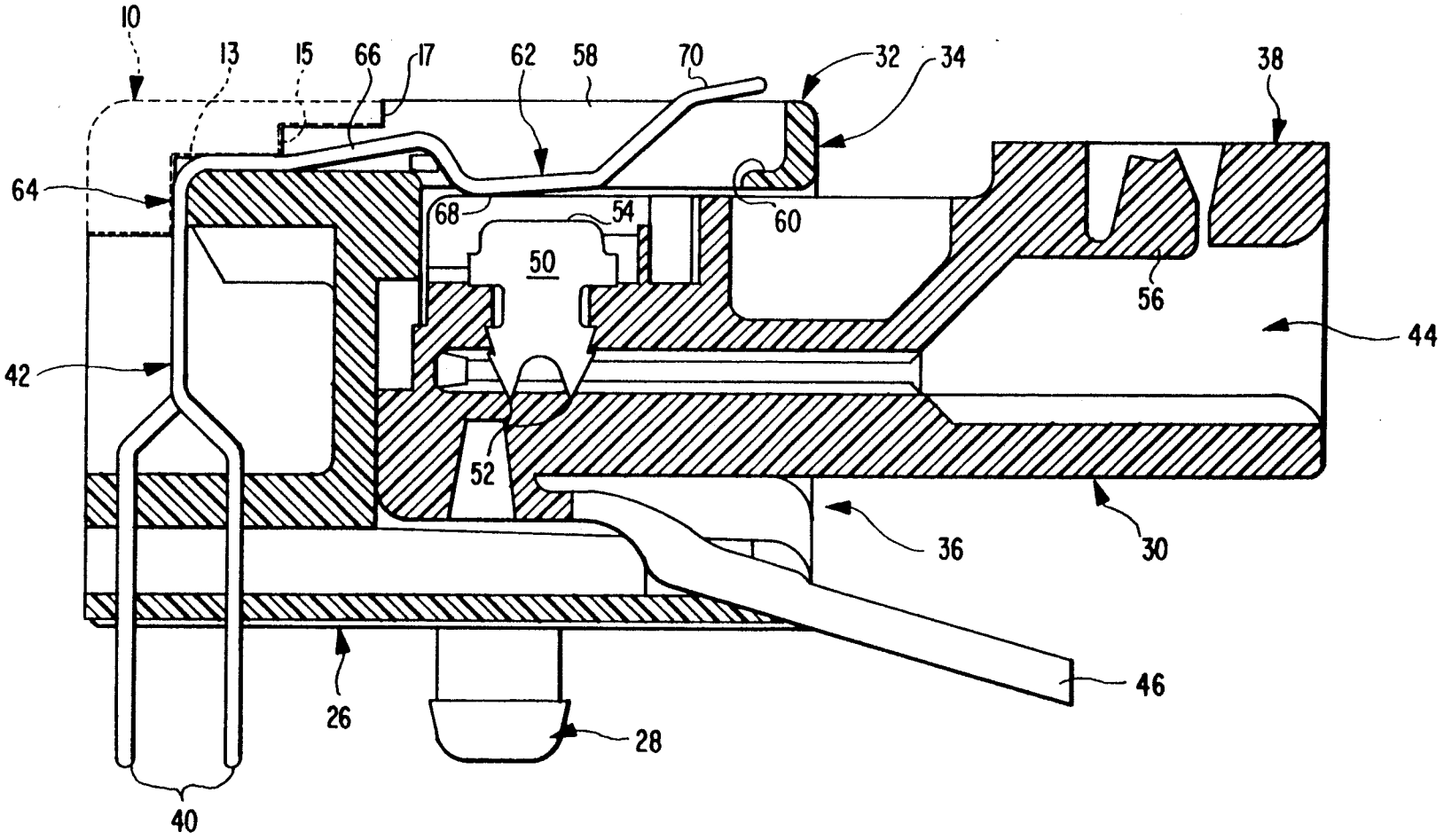
FIG. 2 is a side sectional view illustrating a modular plug inserted into a modular jack.

Referring now to the drawings, wherein like reference numerals represent identical or corresponding parts throughtout the several views, and more particularly to FIGS. 1 and 2 thereof, there is illustrated what is essentially a modular plug, modular jack, and modular jack cap of the prior art.

More particularly, referring first to FIG. 2, there is illustrated a typical modular jack which is indicated generally by reference numeral 26. Modular jack 26 is an improved version of the type set forth in prior U.S. Pat. No. 4,457,570, assigned to the same assignee as the present invention. The improvements represented by modular jack 26 are shown and described in greater detail in co-pending utility patent application Ser. No. 07/827,878, filed Jan. 30, 1992, which is specifically incorporated herein by reference, and which is also assigned to the same assignee as the present invention. These modular jacks are marketed by Virginia Plastics Company Inc., licensee of the present assignee, under the trademark MODCOM-C® (e.g., Part No. 020.000.229).

In particular, modular jack 26 is designed to be mounted directly onto a printed circuit board (PCB) (not shown) by means of mounting feet 28. The PCB normally includes an alternating, staggered hole arrangement for receiving the perpendicularly extending end portions 40 of conductors 42 of jack 26, which will be described in greater detail hereinafter.

As set forth in the co-pending application referenced above, modular jack 26 comprises a unipartite dielectric housing 26 having a separable cap member indicated generally by reference numeral 10.

Referring back to FIG. 1, cap member 10 comprises a substantially rectangular top portion 12 having a pair of shoulders 14 and 16 extending laterally therefrom. The front portion of rectangular top 12 is defined by a leading edge 22. Extending downwardly from shoulders 14 and 16 are a pair of retaining wedges 18 and 20 which are designed to snap-fit into apertures formed in the housing of modular jack 26, all in a manner fully described in the co-pending application referenced above.

Cap 10 also includes on its underside a bearing portion 13 (FIG. 2) which covers the intermediate portions 64 of conductors 42. Bearing portion 13 includes a front face or edge 15 which defines a fulcrum point for the spring contact portions 62 of conductors 42, again in a manner which will be described in greater detail below.

Modular jack 26 includes a top outer wall 32, a front wall 34, and a plug-receiving cavity or opening 36 in which is shown inserted a mating modular plug 30 of conventional construction.

In particular, modular plug 30 comprises a dielectric housing 38 in one end of which is formed a cord-input end 44 for receiving a multi-conductor cord or cable (not shown). Characteristically, a resilient locking tab 46 extends downwardly and rearwardly from the front portion of housing 38. Locking tab 46 cooperates with spaced shoulders (not shown) of housing 26 to secure plug 30 in place, as is well known. Positioned within a plurality of side-by-side slots formed in the front upper part of housing 38 are a plurality of substantially flat, conductive contact terminals 50. Each of the contact terminals 50 includes a pair of downwardly extending, insulation-piercing tangs 52. The upper boundary of contact terminal 50 preferably comprises a flat edge surface 54 which is adapted to electrically contact the spring contact portion 62 of conductors 42 of jack 26, in a manner to be described. Finally, plug 30 characteristically includes a retaining bar 56 which may be rotated from the position illustrated so as to engage the cable inserted into opening 44 so as to provide strain relief, all of which is quite well known in the art.

Returning now to the structure of modular jack 26, it characteristically includes a plurality of side-by-slots 58 extending to the top outer wall 32. Slots 58 are adapted to receive and align the forward spring contact portions 62 of a plurality of side-by-side conductors 42 which are arranged in housing 26. Each slot may be seen to include a lip 60 that extends rearwardly from forward wall 34 and upon which the end of spring contact portion 62 is designed to rest during repose.

As heretofore explained, each of the conductors 42 includes a solder-post portion 40, a spring contact portion 62, and an intermediate portion 64 extending between portions 40 and 62.

More particularly, spring contact portion 62 includes a moment arm 66 which uses the forward edge 15 of jack cap 10 as a fulcrum. Spring contact also includes a lower surface 68 which is adapted to contact the upper edge surface 54 of contact terminal 50, and an end portion 70 which, as explained above, rests on lip 60 during repose.

In FIG. 2, the spring contact portion 62 of conductor 42 is illustrated in a slightly overstressed condition, which can be caused, for example, by inserting an oversized plug into plug-receiving cavity 36. The overstressed condition of spring contact portion 62 is characterized by the fact that end portion 70 extends upwardly above top outer wall 32 of housing 26, as shown in FIG. 2. In this situation, the danger is that the end portion 70 will contact another electrical device or component positioned adjacent housing 26 to cause an electrical malfunction. Another danger is that a barrier will be presented in close juxtaposition to housing 26, against which end portion 70 will bear, thereby possibly malforming the remaining portion of spring contact 62, leading to a malfunctioning of the jack. The difficulty is that, with the exception of forward edge 17 of cap 10, there is no restraint on the upward movement of spring contact portion 62 in an over-stressed condition, and electrical malfunction or jack failure may result. In addition, the space above the spring contacts 62 is open, creating a large air gap that, in a high voltage environment, tends to encourage undesirable arcing.

Figure 3:
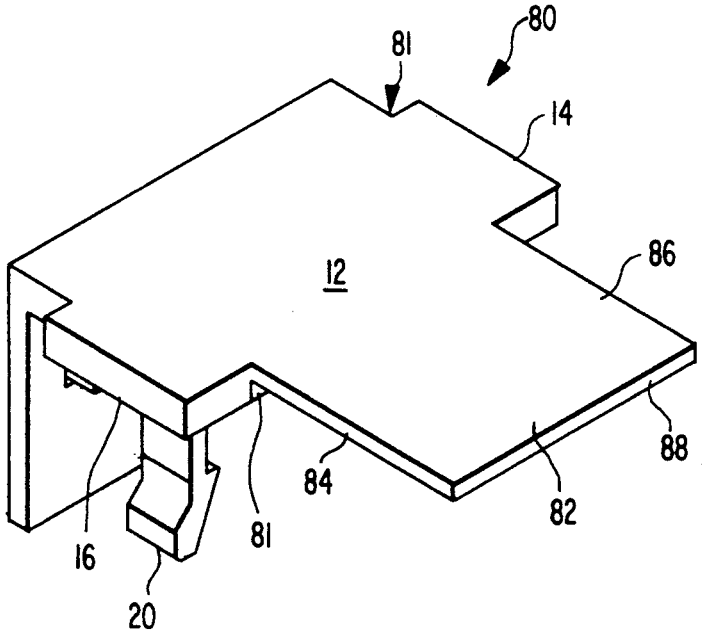
FIG. 3 is a top, perspective view illustrating a preferred embodiment of the present invention.
Figure 4:
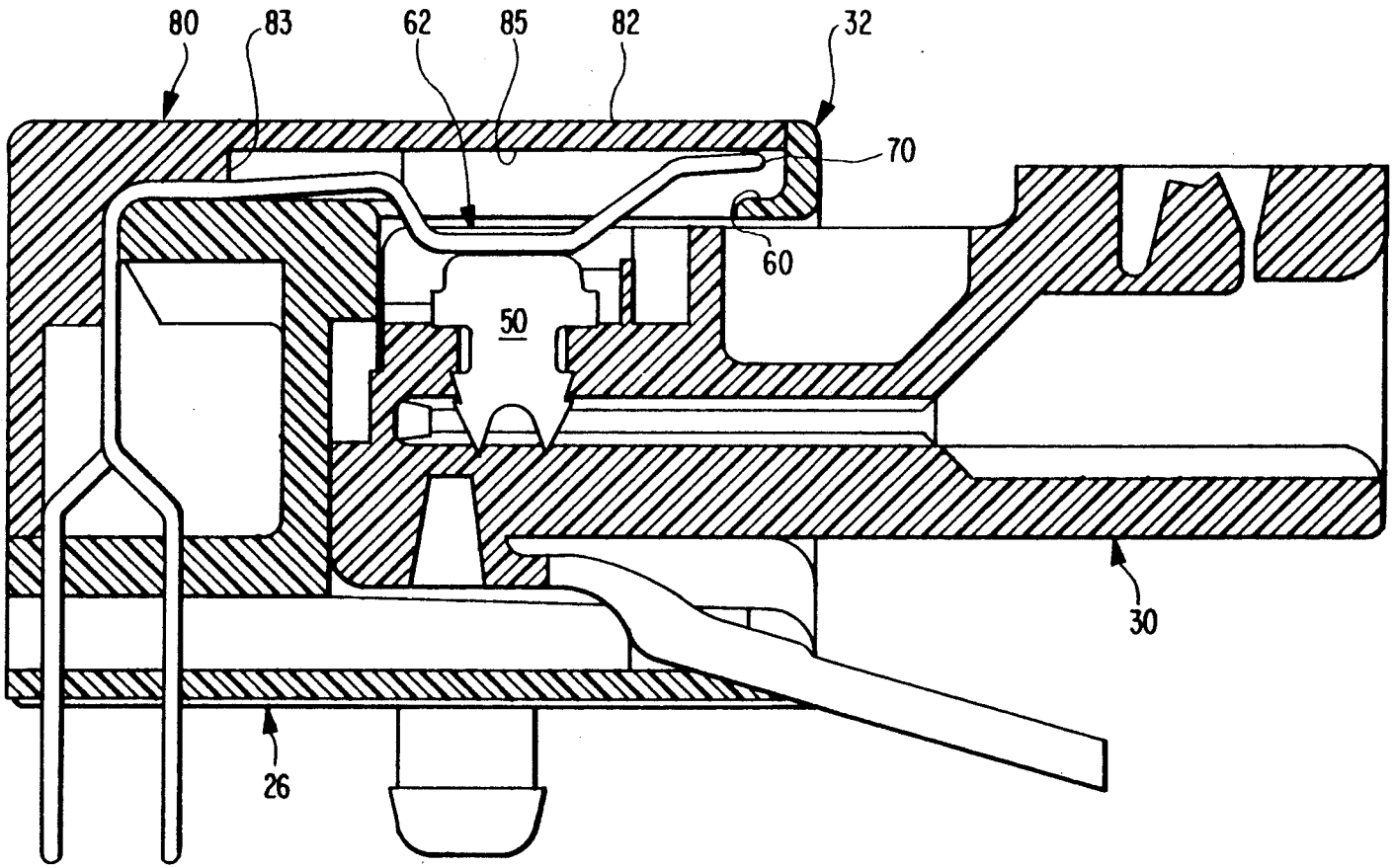
FIG. 4 is a longitudinal sectional view illustrating the preferred embodiment of the present invention installed.
Figure 7:
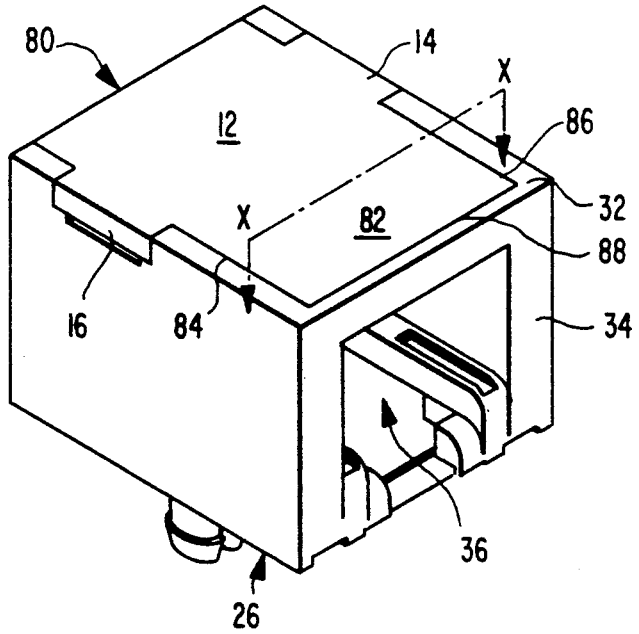
FIG. 7 is a perspective view illustrating a preferred embodiment of the present invention.

In accordance with the present invention, these difficulties are substantially alleviated by the provision of an improved jack cap which is indicated generally by reference numeral 80 in FIG. 3, and which is shown in proper position on a modular jack in FIGS. 4 and 7.

Referring first to FIG. 3, cap 80 of the present invention comprises a main body portion 81 which consists essentially of a rectangular top portion 12 substantially identical to that of the prior art jack cap 10. In addition, extending laterally from top portion 12 in this embodiment are a pair of shoulders 14 and 16, just as with the prior design, from which extend downwardly a pair of interlocking wedges 18 (not shown in this view) and 20.

In accordance with the present invention, extending forwardly from leading edge 22 of rectangular top portion 12 is an extended top wall portion 82. Top wall portion 82 of the present invention is preferably integrally formed with the remainder of cap 80, and is on the order of 0.020 inch thick. It is defined by a front edge 88 and side edges 84 and 86.

Referring now to FIG. 7, there is illustrated a perspective view of modular jack 26, but without any modular plug inserted into plug-receiving opening 36. Also, the cap 80 of the present invention is illustrated installed onto modular jack housing 26. It may be appreciated that the leading edge 88 and side edges 84 and 86 fit within the surrounding frame of top wall 32 of jack housing 26 so as to cover and provide a substantial enclosure for the spring contact portions 62 and other components under the extended top wall portion 82. This greatly reduces the likelihood of high voltage arcing over prior art designs.

Referring back to FIG. 4, the cap 80 is also seen to include on its underside a bearing surface 83 which, similar to bearing surface 15 of cap 10 of FIG. 2, defines a fulcrum for the spring contact portion 62.

The relative position of the elements illustrated in FIG. 4 are that spring contact portion 62 is shown mating properly with contact terminal 50. In this condition, end portion 70 is slightly raised off lip 60, and either does not touch or merely touches slightly the underside 85 of extended top wall portion 82 of cap 80.

Figure 5:
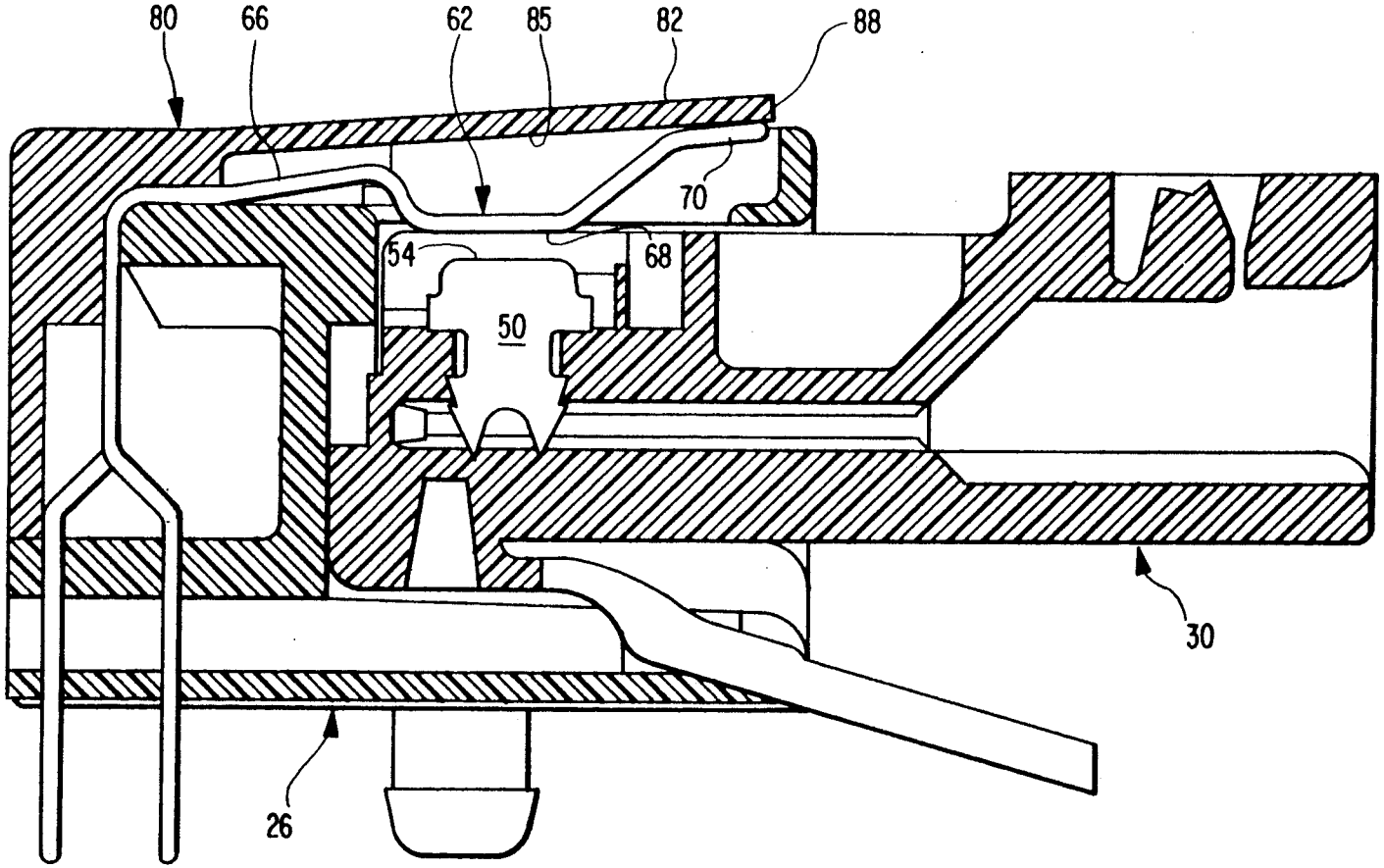
FIG. 5 is a view similar to FIG. 4, but illustrating the present invention in an over stressed condition.
Figure 6:
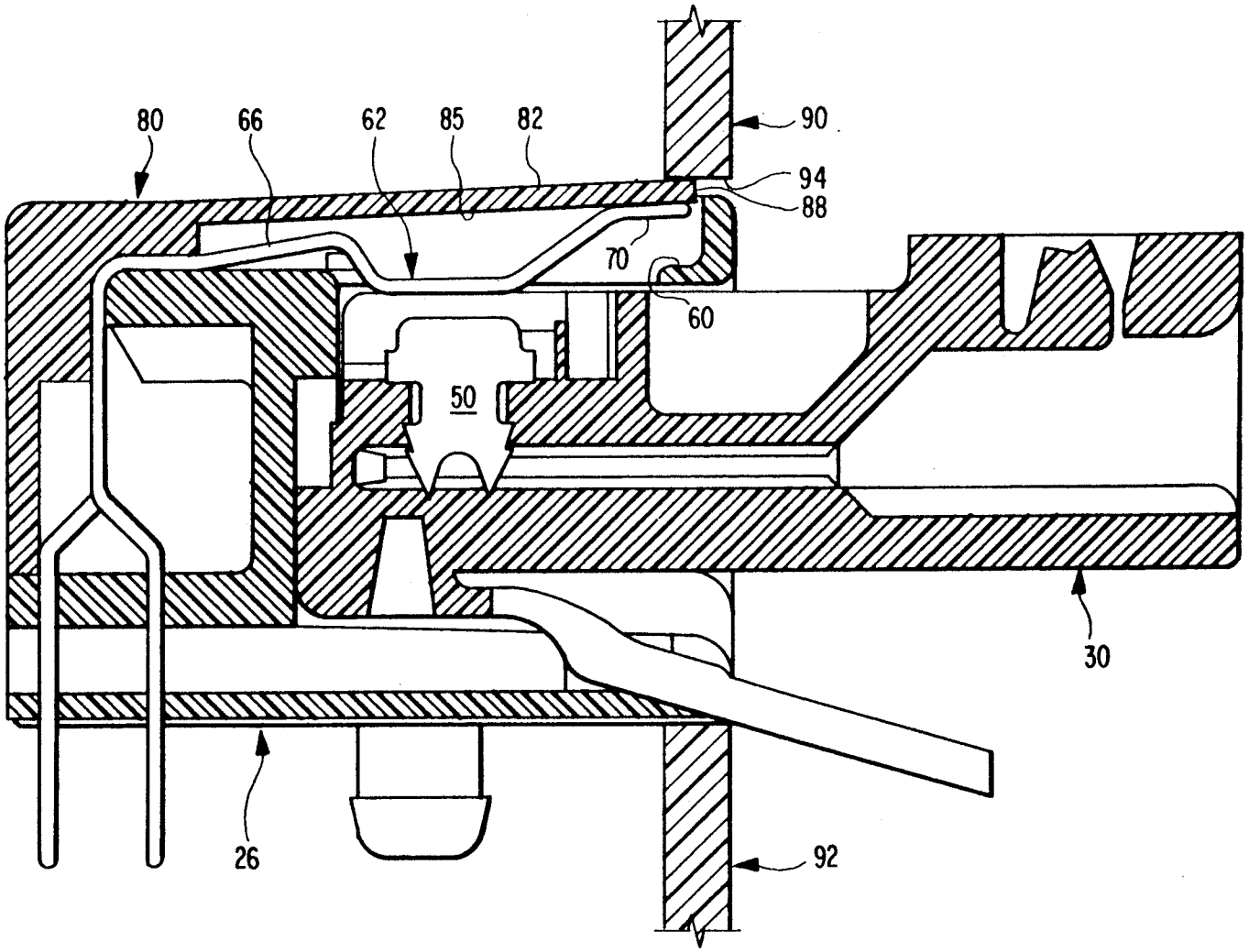
FIG. 6 is a view similar to FIG. 5, but showing how the present invention would operate in a panel opening or other tight enclosure.

In general, an over-stressed condition of spring contact portions 62 can occur in one of two instances: these instances are illustrated respectively in FIGS. 5 and 6. Referring first to FIG. 5, the first instance occurs when, for example, a modular plug of the wrong size is inserted into modular jack 26 (this instance is also shown in FIG. 2). With the present invention as illustrated in FIG. 5, as the end portion 70 presses against the bottom surface 85 of extended top wall portion 82, the latter flexes slightly upwardly, as shown. In this manner, the extended top wall portion 82 provides a dielectric barrier between spring contact portion 62 and whatever electrical components may surround the jack housing 26. This prevents spring contact portion 62 and particularly end portion 70 from inadvertently engaging other electrical devices. When the over-stressed condition is removed, spring contact portions 62 lower to their normal position, as does the extended top portion 82 of cap 80.

The other over-stressed condition is exemplified by FIG. 6, wherein modular jack 26 is shown mounted in a very tight enclosure such as in a panel opening represented by upper and lower partition walls 90 and 92, respectively. In an over-stressed condition, bottom wall 85 of extended top portion 82 is also engaged by end portion 70 of spring contact portion 62. However, the extended top wall portion 82 either cannot move upwardly at all, or can move only a very limited amount vertically before it engages the lower edge 94 of upper partition wall 90. In such a situation, upon further upward flexing of spring contact portion 62, the latter will flex longitudinally (in essence, stretch out). When the offending plug is removed, spring contacts 62 return to their normal position, as does extended top wall portion 82 of cap 80 of the present invention, if it has moved at all. As with the first condition, top wall portion 82 serves to prevent spring contacts 62, and particularly end portions 70 thereof, from engaging other adjacent devices by serving as a dielectric and physical barrier.

Figure 8:
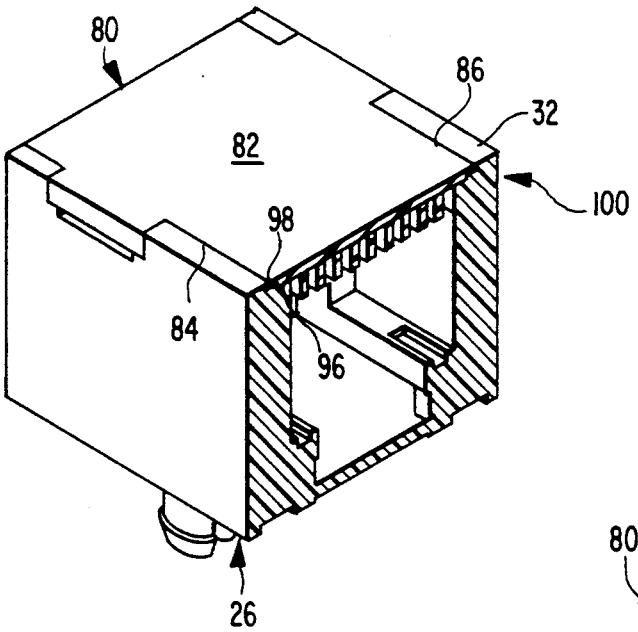
FIG. 8 is a sectional view taken along line X—X of FIG. 7 illustrating a preferred embodiment of the present invention.

Referring now to FIG. 8, there is illustrated one possible embodiment for the interface between the side edges 84 and 86 of jack cap 80 and the surrounding top wall 32 of modular jack 26. In this embodiment, the interface comprises a stairstep configuration indicated generally by reference numeral 100. This stairstep configuration 100 is defined by a first step 96 and a second step 98 formed on the underside of side edges 84 and 86 of extended top wall portion 82. Stairsteps 96 and 98 have complimentary steps, of course, formed in the adjacent sides of top wall 32 of housing 26 so as to mate therewith. This stairstep configuration has the advantage of making it more difficult in a high voltage application for arcing to occur by reducing the possibility of a line-of-sight air gap forming. Yet, in this embodiment, top wall portion 82 is still free to flex upwardly, absent a tight enclosure.

Figure 9:
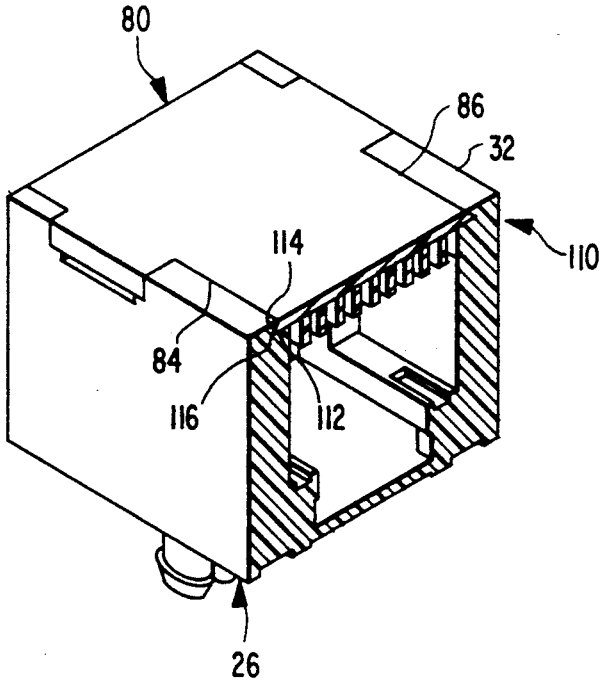
FIG. 9 is a sectional view taken along line X—X of FIG. 7 illustrating an alternate embodiment of the present invention.

Referring now to FIG. 9, there is illustrated an alternate embodiment wherein the interface is defined by a V-shaped wedge indicated generally by reference numeral 110. Wedge 110 is defined by a lateral bottom surface 112 and an inclined surface 114 that is preferably formed at an acute angle to bottom surface 112 so as to define a sharp tip or edge 116. V-shaped wedge 110 is designed to mate with a complimentary formed recess extending along the side frames of top wall 32 of jack 26. This particular embodiment may be snap-fit into place. In addition to inhibiting high-voltage arcing by closing the air gap, the interlock provided by the V-shaped wedge 110 helps prevent cap 80 from lifting off jack housing 26.

Figure 10:
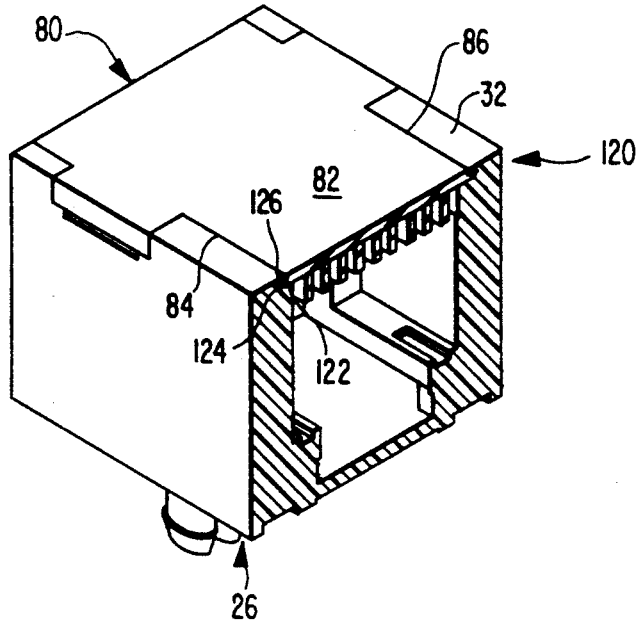
FIG. 10 is a sectional view taken along line X—X of FIG. 7 illustrating yet another alternate embodiment of the present invention.

FIG. 10 illustrates yet another alternate embodiment which combines the step function of FIG. 8 with the wedge function of FIG. 9, albeit in an inverted configuration. More particularly, the step and reverse-wedge interface 120 includes a bottom horizontal surface 122, an angled side surface 124, and a stepped surface 126. This configuration acts to form a lip 35 in the side frames of top wall 32 of housing 26 for interlocking with the step and reverse-wedge 120. This embodiment also inhibits high voltage arcing and substantially inhibits lifting of jack cap 80. This configuration may also be snap-fit into place.

Since the side edges 84 and 86 of extended top wall portion 82 of the embodiments of FIGS. 9 and 10 are effectively secured, there is no upward movement (except perhaps for some central bowing) of top wall portion 82 in an overstressed condition. Thus, these embodiments operate in a manner analogous to that of FIG. 6 where upward movement of top wall portion 82 is limited.

FIGS. 11–14 illustrate an alternate embodiment of the jack cap 130 of the present invention which eliminates the shoulders 14 and 16 of the previous embodiments. In this manner, the jack cap 130 may be slid into the side frames of the top wall 32 of modular jack housing 26' from the rear, rather than being snap-fit into place as with FIGS. 7–10. The jack cap 130 of FIG. 11 includes therefore straight lateral sides 132 and 134, a rear portion 136, and a forward portion 138 which covers the spring contact portions of jack 26'.

Figure 11:
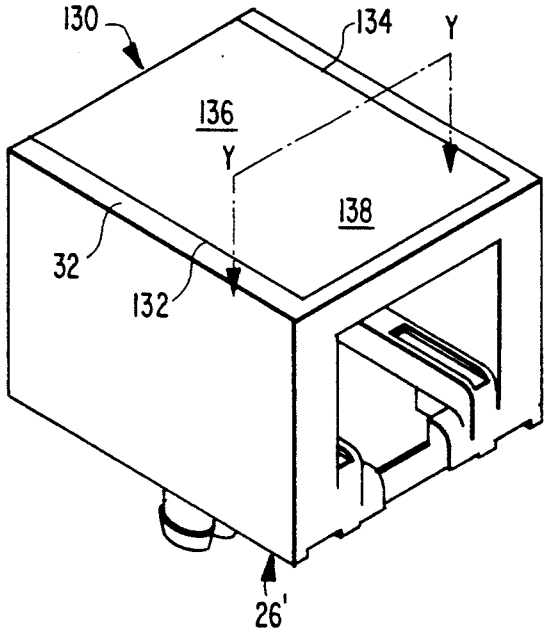
FIG. 11 is a perspective view illustrating still another alternate embodiment of the present invention.
Figure 12:
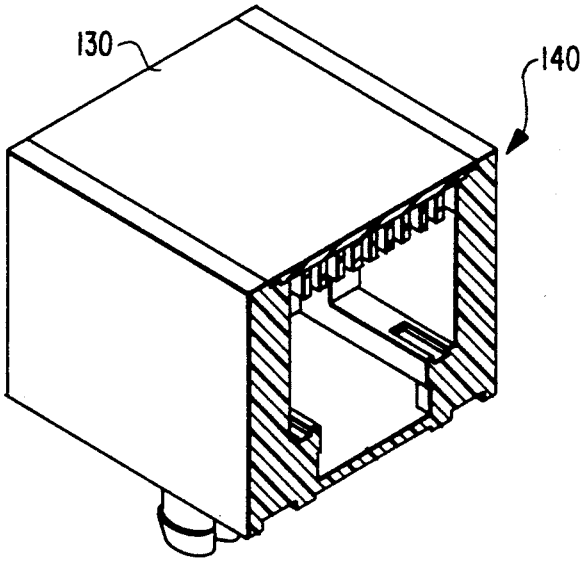
FIG. 12 is a sectional view taken along line Y—Y of FIG. 11 showing an alternate embodiment of the present invention.
Figure 13:
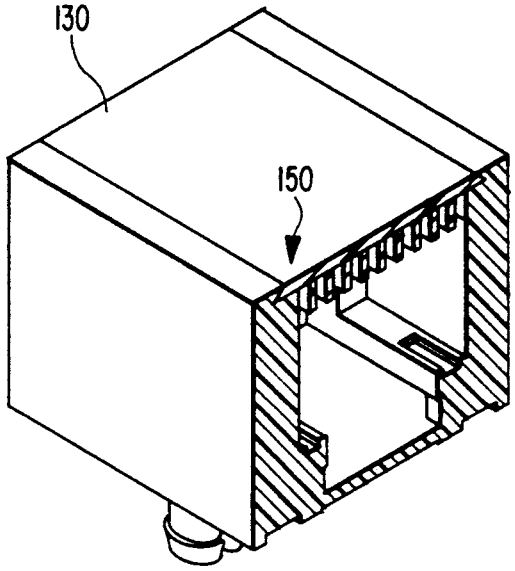
FIG. 13 is a sectional view taken along line Y—Y of FIG. 11 showing an alternate embodiment of the present invention.
Figure 14:
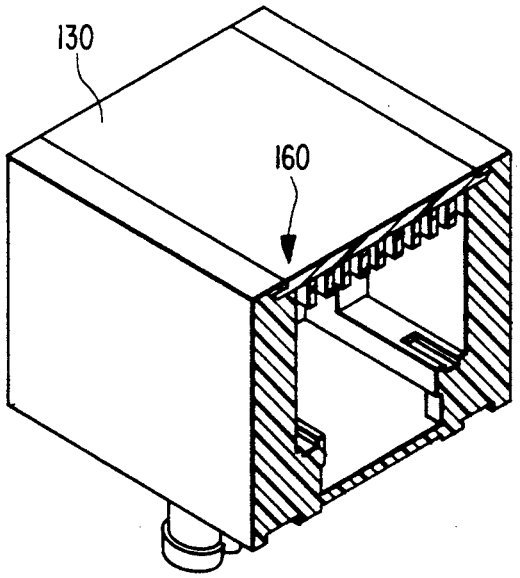
FIG. 14 is a sectional view taken along line Y—Y of FIG. 11 showing yet another alternate embodiment of the present invention.

FIGS. 12, 13 and 14 are similar to the embodiments of FIGS. 8, 9 and 10 in that they employ similar interfaces between the jack cap and the top wall of the modular jack housing; however, FIGS. 12–14 employ the "shoulderless" embodiment of FIG. 11.

More particularly, FIG. 12 illustrates the jack cap 130 with a stairstep interface 140, FIG. 13 illustrates jack cap 130 with a wedge interface 150, and FIG. 14 illustrates jack cap 130 with a step and reverse-wedge interface 160.

Obviously, numerous modifications and variations of the present invention are possible in light of the above teachings. It is therefore to be understood that within the scope of the appended claims, the invention may be practiced otherwise than as specifically described herein.

I claim as my invention:

1. A telephone-type modular jack of the type that connects a telephone-type modular plug with a printed circuit board; said jack comprising:

a housing having a front portion, a rear portion, an upper outer wall, an opening formed in said front portion of said housing for receiving the telephone-type modular plug having a cord terminated by a plurality of side-by-side, substantially planar contact terminals, said contact terminals including a substantially flat, elongated upper edge surface;

a plurality of electrical conductors arranged in a side-by-side, spaced apart fashion in said housing, each of said conductors including an end portion extending normally from said rear portion for insertion through a corresponding hole formed in the printed circuit board, a spring contact portion extending into said opening from said rear portion of said housing towards said front portion of said housing and including a substantially linear lower portion, and an intermediate portion formed between said end portion and said spring contact portion;

said upper edge surface of said contact terminals of said telephone-type modular plug engaging said linear lower portion of said spring contact portions of said conductors causing said spring contact portions of said conductors to be pivoted upwardly about a fulcrum point upon insertion of said telephone-type modular plug into said opening of said telephone-type modular jack; and means for limiting the upward movement of said spring contact portions of said conductors, said means comprising a separable cap member having a main body portion overlying said intermediate portion of said conductors and cover means extending forwardly from said main body portion over said spring contact portions of said conductors for covering same.

2. A telephone-type modular jack as set forth in claim 1, wherein said cover means extends integrally from and is flexibly secured to said main body portion of said separable cap member.

3. A telephone-type modular jack of the type that connects a telephone-type modular plug with a printed circuit board; said jack comprising:

a housing having a front portion, a rear portion, an upper outer wall, an opening formed in said front portion of said housing for receiving the telephone-type modular plug having a cord terminated by a plurality of side-by-side, substantially planar contact terminals, said contact terminals including a substantially flat, elongated upper edge surface;

a plurality of electrical conductors arranged in a side-by-side, spaced apart fashion in said housing, each of said conductors including an end portion extending normally from said rear portion for insertion through a corresponding hole formed in the printed circuit board, a spring contact portion extending into said opening from said rear portion of said housing towards said front portion of said housing and including a substantially linear lower portion, and an intermediate portion formed between said end portion and said spring contact portion;

said upper edge surface of said contact terminals of said telephone-type modular plug engaging said linear portion of said spring contact portions of said conductors causing said spring contact portions of said conductors to be pivoted upwardly about a fulcrum point upon insertion of said telephone-type modular plug into said opening of said telephone-type modular jack;

means for limiting the upward movement of said spring contact portions of said conductors;

wherein said means for limiting the upward movement of said spring contact portions of said conductors comprises a separable cap member;

wherein said separable cap member has a main body portion and bearing means positioned in contact with said intermediate portion of said conductors for defining a fulcrum point for said spring contact portions positioned forwardly of said fulcrum point;

wherein said separable cap member further includes cover means extending from said main body portion over said spring contact portions of said conductors for covering same;

wherein said separable cap member includes means for securing same to said housing;

wherein said bearing means is located on the underside of said cap member, and said cover means extends forwardly from said main body portion;

wherein said cover means extends integrally from and is flexibly secured to said main body poriton of said separable cap member; and wherein said cover means flexes upwardly in response to pressure on its undersurface from said spring contact portions of said conductors.

4. A telephone-type modular jack as set forth in claim 3, wherein said cover means is substantially rectangular and covers substantially the entire opening above said spring contact portions of said conductors.

5. A telephone-type modular jack of the type that connects a telephone-type modular plug with a printed circuit board; said jack comprising;

a housing having a front portion, a rear portion, an upper outer wall, an opening formed in said front portion of said housing for receiving the telephone-type modular plug having a cord terminated by a plurality of side-by-side, substantially planar contact terminals, said contact terminals including a substantially flat, elongated upper edge surface;

a plurality of electrical conductors arranged in a side-by-side, spaced apart fashion in said housing, each of said conductors including an end portion extending normally from said rear portion for insertion through a corresponding hole formed in the printed circuit board, a spring contact portion extending into said opening from said rear portion of said housing towards said front portion of said housing and including a substantially linear lower portion, and an intermediate portion formed between said end portion and said spring contact portion;

said upper edge surface of said contact terminals of said telephone-type modular plug engaging said linear portion of said spring contact portions of said conductors causing said spring contact portions of said conductors to be pivoted upwardly about a fulcrum point upon insertion of said telephone-type modular plug into said opening of said telephone-type modular jack;

means for limiting the upward movement of said spring contact portions of said conductors;

wherein said means for limiting the upward movement of said spring contact portions of said conductors includes means for insulating said spring contact portions from touching other electrical devices;

wherein said means for limiting the upward movement of and for insulating said spring contact portions of said conductors comprises a separable cap member;

wherein said separable cap member includes a main body portion, a cover portion extending forwardly from said main body portion, and means for securing said cap member to said housing;

wherein said cover portion comprises a cover integrally extending forwardly from said main body portion for covering substantially the entire opening above said spring contact portions of said conductors; and wherein said cover includes means for flexing upwardly as said spring contact portions of said conductors press upwardly on the underside of said cover.

6. A telephone-type modular jack as set forth in claim 1, wherein said separable cap member includes means for securing same to said housing.

7. A telephone-type modular jack as set forth in claim 6, wherein said cover means of said separable cap member includes a front edge and side edges, said means for securing said separable cap member to said housing comprising means formed along said side edges of said cover means of said cap member for interfacing with complimentary means formed in said housing of said modular jack.

8. A telephone-type modular jack as set forth in claim 7, wherein said means formed along said side edges of said cover means of said cap member comprises a stairstep configuration.

9. A telephone-type modular jack as set forth in claim 7, wherein said means formed along said side edges of said cover means of said cap member comprises a wedge-shaped configuration.

10. A telephone-type modular jack as set forth in claim 7, wherein said means formed along said side edges of said cover means of said cap member comprises a step and reverse-wedge configuration.

11. A telephone-type modular jack as set forth in claim 7, wherein said means formed along said side edges includes means for reducing the likelihood of arcing in said jack.

12. A telephone-type modular jack as set forth in claim 6, wherein separable cap member includes a front edge, lateral edges, and shoulder means formed along said lateral edges, said means for securing said separable cap member to said housing comprising retaining wedge means extending downwardly from said shoulder means.

13. A telephone-type modular jack as set forth in claim 12, wherein said cover means of said separable cap member includes said front edge and side edges extending rearwardly from said front edge to said shoulder means, said means for securing said separable cap member to said housing comprising means formed along said side edges of said cover means of said cap member for interfacing with complimentary means formed in said housing of said modular jack.

14. A telephone-type modular jack as set forth in claim 13, wherein said means formed along said side edges of said cover means of said cap member comprises a stairstep configuration.

15. A telephone-type modular jack as set forth in claim 13, wherein said means formed along said side edges of said cover means of said cap member comprises a wedge-shaped configuration.

16. A telephone-type modular jack as set forth in claim 13, wherein said means formed along said side edges of said cover means of said cap member comprises a step and reverse-wedge configuration.

17. A telephone-type modular jack as set forth in claim 13, wherein said means formed along said side edges includes means for reducing the likelihood of arcing in said jack.

18. A modular, telephone-type electrical connector, comprising:

a modular jack characterized by a housing, a plurality of conductors arranged side-by-side in said housing, each conductor including a printed circuit matable portion and a spring contact portion for mating with a modular plug, said spring contact portion extending into said housing from the rear thereof to the front thereof and adapted to move upwardly about a fulcrum in a direction out of said housing upon insertion of a modular plug into said housing; and removable cap means for insulating said spring contact portions of said conductors from touching other devices when said spring contact portions move about said fulcrum upwardly out of said housing, said removable cap means comprising (i) a main body portion overlying and abutting said fulcrum and (ii) a thin, flexible cover portion that extends forwardly from said main body portion and overlies said spring contact portions and includes side edges for seating said cover portion in said housing.

19. A modular, telephone-type electrical connector as set forth in claim 18, wherein said removable cap means further includes means for limiting the upward movement of said spring contact portions.

20. A modular, telephone-type electrical connector as set forth in claim 19, wherein said removable cap means includes means for releasably securing same to said housing.

21. A modular, telephone-type electrical connector as set forth in claim 20, wherein said removable cap means includes a front edge, lateral edges, and shoulder means formed along said lateral edges, said means for releasably securing said removable cap means to said housing comprising retaining wedge means extending downwardly from said shoulder means.

22. A modular, telephone-type electrical connector as set forth in claim 20, wherein said releasably securing means is located along said side edges of said cover portion.

23. A modular, telephone-type electrical connector as set forth in claim 22, wherein said side edges of said cover portion comprises a stairstep configuration.

24. A modular, telephone-type electrical connector as set forth in claim 22, wherein said side edges of said cover portion comprises a wedge-shaped configuration.

25. A modular, telephone-type electrical connector as set forth in claim 22, wherein said said side edges of said cover portion comprises a step and reverse-wedge configuration.

26. A modular, telephone-type electrical connector as set forth in claim 22, wherein said side edges of said cover portion includes means for reducing the likelihood of arcing in said jack.

27. A modular, telephone-type electrical connector, comprising:

a modular jack characterized by a housing, a plurality of conductors arranged side-by-side in said housing, each conductor including a printed circuit matable portion and a spring contact portion for mating with a modular plug, an opening normally located above said spring contact portion, said spring contact portion extending into said housing from the rear thereof to the front thereof and adapted to move upwardly about a fulcrum in a direction through said opening out of said housing upon insertion of a modular plug into said housing; and separable cap member means for reducing the likelihood of arcing in said jack, said separable cap member means comprising a main body portion overlying said fulcrum, a cover portion extending forwardly from said main body portion for covering substantially all of said opening above said spring contact portions of said conductors and means for securing said cap member to said housing.

28. A modular, telephone-type electrical connector as set forth in claim 27, wherein said cover includes a front edge and side edges, said means for reducing the likelihood of arcing comprising means formed along said side edges of said cover for interfacing with complimentary means formed in said housing of said modular jack.

29. A modular, telephone-type electrical connector as set forth in claim 28, wherein said means formed along said side edges of said cover comprises a stairstep configuration.

30. A modular telephone-type electrical connector as set forth in claim 28, wherein said means formed along said side edges of said cover comprises a wedge-shaped configuration.

31. A modular telephone-type electrical connector as set forth in claim 28, wherein said means formed along said side edges of said cover comprises a step and reverse-wedge configuration.

32. A modular telephone-type electrical connector as set forth in claim 28, wherein said means formed along said side edges includes means for insulating and limiting the upward movement of said spring contact portions of said conductors.

* * * * *